US005421240A

United States Patent [19]

Ohta et al.

[11] Patent Number: 5,421,240

[45] Date of Patent: Jun. 6, 1995

[54] AUTOSHUT-OFF DEVICE FOR OIL PRESSURE TYPE PULSE WRENCH

[75] Inventors: Masaji Ohta; Toshikazu Kitamura, both of Osaka, Japan

[73] Assignee: Fuji Kuuki Kabushiki Kaisha, Osaka, Japan

[21] Appl. No.: 102,903

[22] Filed: Aug. 6, 1993

[51] Int. Cl.[6] ..... F01C 21/12

[52] U.S. Cl. ..... 91/59; 173/177

[58] Field of Search ..... 91/59; 173/177, 180, 173/181, 20

[56] References Cited

U.S. PATENT DOCUMENTS

| | | | |
|---|---|---|---|
| 3,116,617 | 1/1964 | Skoog . | |
| 3,368,631 | 2/1968 | MacNaughton | 173/177 |
| 3,572,447 | 3/1971 | Pauley | 173/20 |
| 3,596,718 | 8/1971 | Fish et al. | 91/59 |
| 5,113,949 | 5/1992 | Ohkubo et al. | 173/177 |
| 5,277,261 | 1/1994 | Sakoh | 173/20 |

*Primary Examiner*—F. Daniel Lopez

*Attorney, Agent, or Firm*—Armstrong, Westerman, Hattori, McLeland & Naughton

[57] ABSTRACT

This invention is intended to effect torque control of high accuracy by detecting the oil pressure at the time of the generation of a pulse which forms the basis of the generated torque for a torque wrench and using the data thus obtained the effect torque control. Oil pressure pulses generated in a pulse generating mechanism 3 by the rotation of an air motor 1 are transmitted to a hydraulic cylinder 4 by a piston 33, a rod 36 and a piston 35. In addition, a pressure sensor 5 installed in the hydraulic cylinder 34 detects the oil pressure pulses and its signal is used to switch a switching valve 7, whereupon a stopping switching valve 9 and a stopping differential pressure valve 8 are successively switched, stopping the feeding of air to the air motor 1 while cutting of the passage of electric current from a battery 61 to an electric control circuit 6.

5 Claims, 3 Drawing Sheets

AUTOSHUT-OFF DEVICE FOR OIL PRESSURE TYPE PULSE WRENCH

BACKGROUND OF THE INVENTION

1. Field of Industrial Applicability

This invention relates to an autoshut-off mechanism for controlling the torque in the shaft of a torque wrench.

2. Prior Art

A torque wrench using an air motor as a power source is provided with a shut-off mechanism adapted to stop the rotation of the motor when a bolt or nut has been seated by a predetermined value of torque. The autoshut-off mechanism which develops this function operates on the principle of detecting the stoppage or reversal of rotation of the rotor by means of an inertial body connected to the rotor, the movement of said inertial body opening an air feed valve to feed air to an air timer, then shutting off the feeding of air to the air motor after the lapse of given time after the start of seating.

Further, Japanese Utility Model Application Disclosure No. 40078/1991 discloses an autoshut-off device for a torque wrench adapted to intermittently transmit the rotational output from an air motor and including a pulse generating mechanism which produces an oil pressure pulse each time the torque is imparted to the main shaft, said autoshut-off device being characterized in that the oil pressure in the high pressure producing side of said mechanism acts on a relief valve, so that the latter is opened when said oil pressure exceeds a set pressure set by the spring pressure of said relief valve, the then—prevailing oil pressure being used to stop the rotation of the air motor.

In the two prior art examples described above, the former, though capable of providing some degree of torque accuracy, is not so designed as to merit for the produced torque to actuate the autoshut-off device by said generated torque; therefore, there has been a problem that the torque accuracy is readily influenced by the performance of the torque wrench itself or by the operating conditions.

In the latter, since an oil pressure pulse can be generated only to a very short time, there is a drawback that the oil pressure often fails to be transmitted to a bolt or nut to serve as a tightening force. Further, since the air motor will be stopped if the oil pressure in the high pressure producing side becomes higher than the spring pressure of the relief valve, only the lower limit of the generated torque is monitored; there has been a problem that a variation in the performance of machine parts, such as springs, unstabilizes the operating accuracy.

SUMMARY OF THE INVENTION

This invention has been accomplished with the above drawbacks and problems in mind and is intended to provide an autoshut-off device for an oil pressure type pulse wrench which operates on the principle of detecting an oil pressure at the time of generation of a pulse which forms the basis of the generated torque for the torque wrench, and using this data to effect more accurate torque control.

An autoshut-off device for an oil pressure type pulse wrench according to claim 1 comprises a fluid pressure motor, a fluid pressure circuit for controlling the fluid pressure motor, a pulse generating mechanism intermittently transmitting the rotational output to a main shaft by means of a generated pulse to impart torque to the main shaft, means for reading oil pressure pulses generated in the pulse generating mechanism, electric control means for comparing the oil pressure pulses read by said reading means with a set pressure and converting the result of this comparison into an electric signal to output the latter, and shut-off means for stopping the feeding of fluid to said fluid pressure motor in response to the output from said electric control means when said oil pressure pulse exceeds the set pressure.

An autoshut-off device for an oil pressure type pulse wrench according to claim 2 is characterized in that the electric control means is provided with counting means which, when oil pressure pulses exceed the set pressure a predetermined number of times, issues a signal, An autoshut-off device for an oil pressure type pulse wrench according to claim 3 is characterized in that the electric control means is capable of setting the upper and lower limits of the set pressure and uses the lower limit during control of said counting means, the arrangement being such that an NG signal is delivered when the oil pressure pulse exceeds the upper limit of the set pressure.

An autoshut-off device for an oil pressure type pulse wrench according to claim 4 is characterized in that the reading means is a pressure sensor for detecting the fluid pressure transmitted by the thrust of the oil pressure pulses.

An autoshut-off device for an oil pressure type pulse wrench according to claim 5 is characterized in that the reading means is a load cell adapted to produce compressive strains owing to the fluid pressure transmitted by the thrust of the oil pressure pulses.

An autoshut-off device for an oil pressure type pulse wrench according to claim 6 is characterized in that the power source for the electric control means is a battery contained in a housing.

According to an autoshut-off device for an oil pressure type pulse wrench as set forth in claim 1, an oil pressure pulse corresponding to the torque of the main shaft read by the reading means is directly compared with the set pressure, and if the oil pressure pulse exceeds the set pressure, the output from the electrical control means delivers a signal for the shut-off means to stop the feeding of fluid to the fluid pressure motor, thereby stopping the rotation of the fluid pressure motor.

According to an autoshut-off device for an oil pressure type pulse wrench as set forth in claim 2, the number of generated oil pressure pulses exceeding the set pressure set by the electric control means is monitored to ensure that a sufficient tightening force is transmitted from the main shaft to a bolt or nut.

According to an autoshut-off device for an oil pressure type pulse wrench as set forth in claim 3, if the value of an oil pressure pulse is excessively increased by some cause other than the tightening force transmitted to a bolt or nut, such cause can be eliminated.

According to an autoshut-off device for an oil pressure type pulse wrench as set forth in claim 4, the reading means can be inexpensively produced.

According to an autoshut-off device for an oil pressure type pulse wrench as set forth in claim 5, the handling of the reading means becomes easier.

According to an autoshut-off device for an oil pressure type pulse wrench as set forth in claim 6, since the battery is contained in the housing, there is no need of extending the electric wiring out of the housing to feed the electric control circuit (electric control means).

DESCRIPTION OF THE PREFERRED EMBODIMENTS

Figure 1:
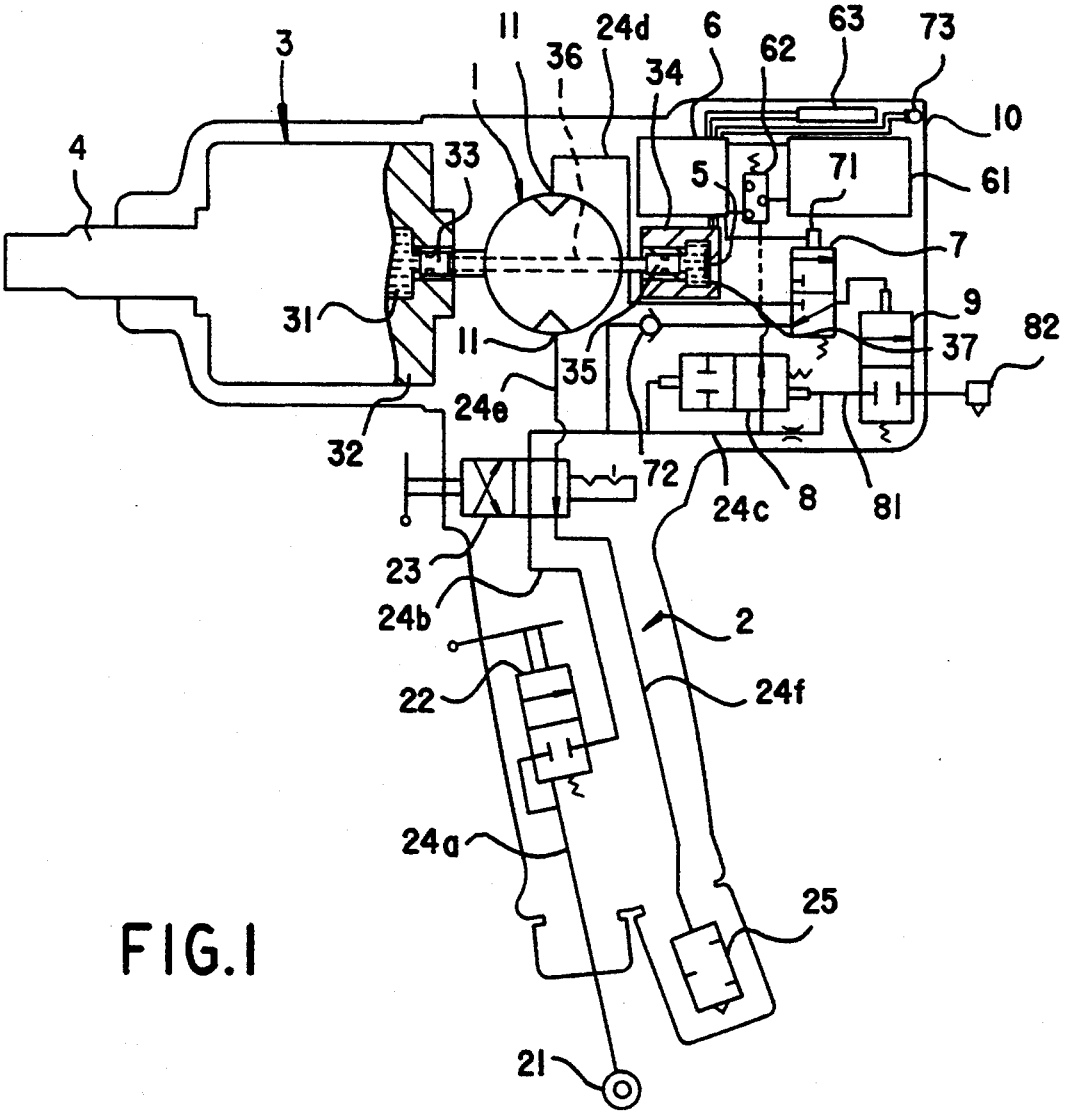
FIG. 1 is a schematic diagram showing an autoshut-off device according to an embodiment of this invention.
Figure 3:
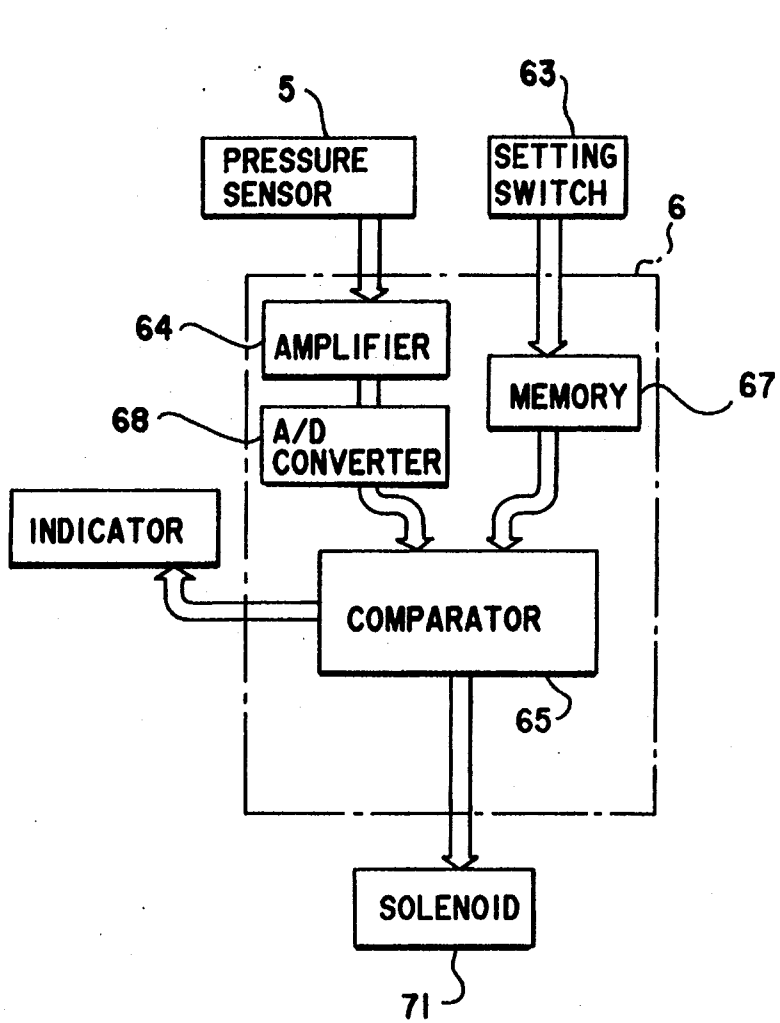
FIG. 3 is a block diagram of a better electric control circuit used in the autoshut-off device.
Figure 4:
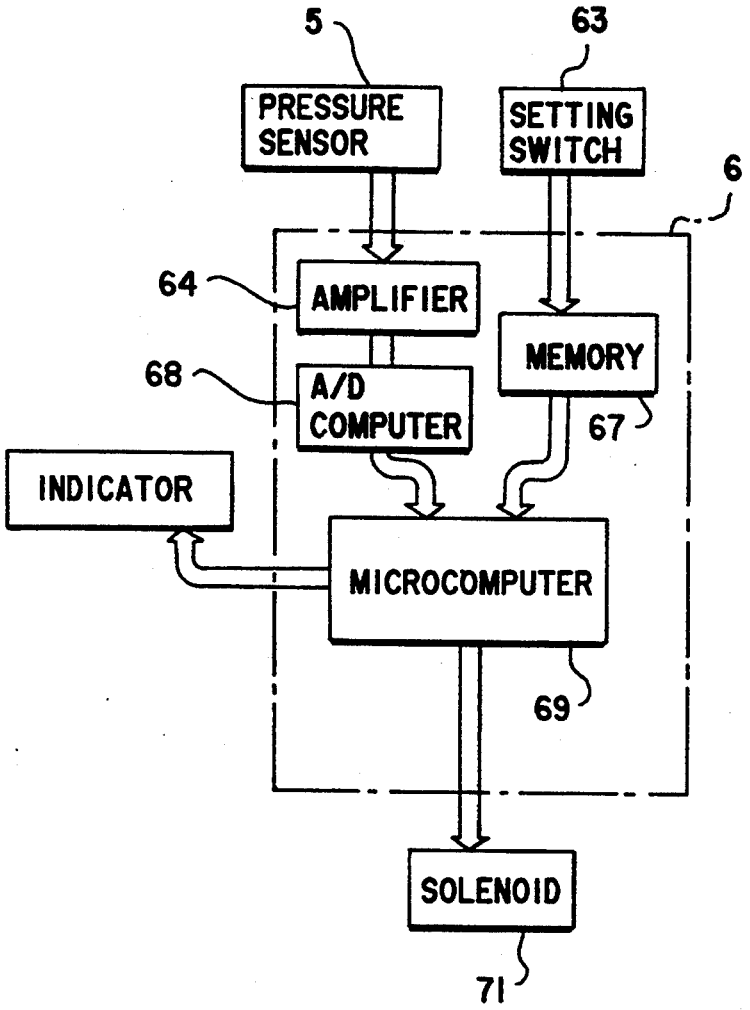
FIG. 4 is a black diagram of still another electric control circuit used in the autoshut-off device.

FIG. 1 is a schematic diagram showing an autoshut-off device according to an embodiment of this invention. Further, FIGS. 2, 3 and 4 show different examples of electric control circuits used in the autoshut-off device.

In FIG. 1, the numeral 1 denotes an air motor designed so that the direction of its rotation depends on the direction of its air flow. An air circuit 2 for controlling the air motor 1 comprises an air source 21, an air feed valve 22, a rotational direction control valve 23, and air passageways 24*a* through 24*e* connecting these components together, said air passageways 24*d* and 24*e* being connected to the air feed and discharge ports 11, the passageway 24*f* having a muffler 25 connected thereto. The numeral 3 denotes a pulse generating mechanism which is known, as described in Japanese Utility Model Application Disclosure No. 40076/1991 mentioned at the outset, and a detailed description of said mechanism is omitted herein. The pulse generating mechanism 3 is designed so that it intermittently transmits the rotational output from the air motor 1 to the main shaft 4 and each time it imparts the torque to the main shaft 4, it generates an oil pressure pulse which matches this torque. A top cover 32 defining an oil pressure pulse transmitting chamber 31 is centrally provided with a small-diameter piston 33 opposed to the piston 35 of a hydraulic cylinder 34 with the air motor 1 disposed therebetween. These pistons 33 and 35 are connected together by a transmission rod 36 extending centrally through the air motor 1. The oil pressure chamber 37 of the hydraulic cylinder 34 has a pressure sensor 5 disposed therein which is an example of means for reading oil pressure pulses generated to the high pressure chamber. The oil pressure pulses read by the pressure sensor 5 are processed in an electric control circuit 6. Used as a power source for the electric control circuit 6 is a battery 61 contained in a housing 61. The numeral 7 denotes a switching valve to the form of a 2-position solenoid valve having a solenoid 71 adapted to be actuated by an output signal from the electric control circuit 6. The numeral 8 denotes a differential pressure valve for stoppage and 9 denotes a switching valve for stoppage. These three valves constitutes shut-off means, That is, the stopping switching valve 8 is interposed between the air passageways 24*c* and 24*d*, with the air pressure in the air passageway 24*c* acting on both sides of said switching valve 8. The numeral 82 denotes an exhaust port connected to the stopping switching valve 9. One side of the stopping switching valve 9 is connected to the air passageway 24*d* or check valve 72. Further, the electric control circuit 6 and the battery 61 are connected together through a pressure switch 62. This pressure switch 62 has the function of maintaining electrical conduction when the air passageway 24*d* is in the high pressure state and cutting off the electrical conduction when the air passageway 24*d* is in the low pressure state.

The air feed valve 22, the rotational direction switching valve 23, the switching valve 7, the stopping differential pressure valve 8, and the stopping switching valve 9 are each in the form of a 2-position switching valve. Further, these components described above are received in the torque wrench housing 10 except for the air source 21 and part of the air passageway 24*a*.

Figure 2:
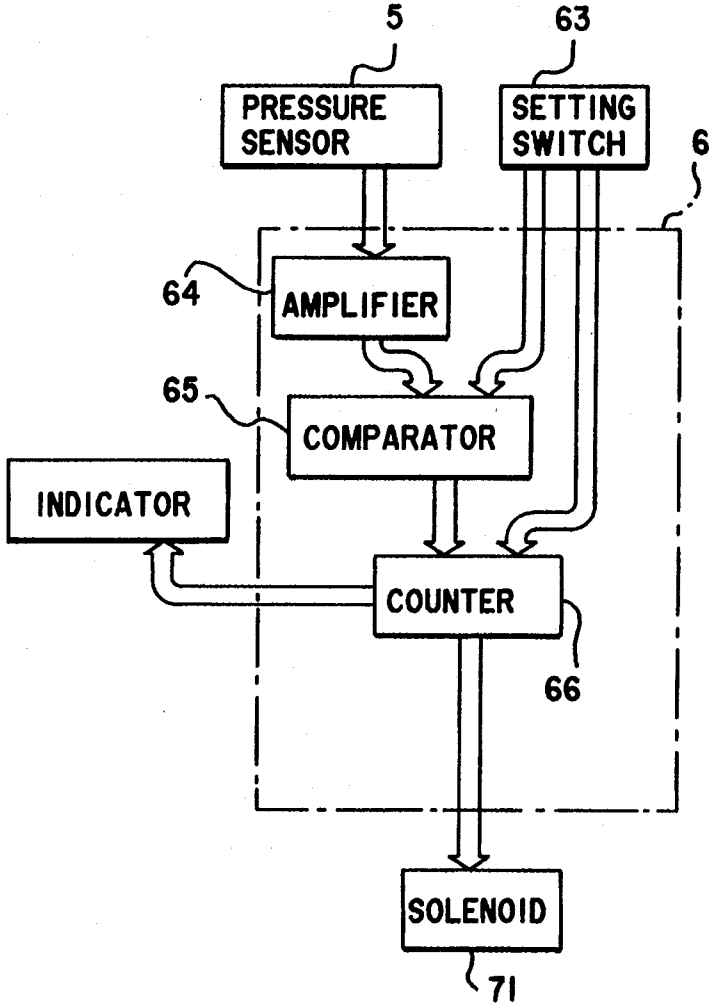
FIG. 2 is a block diagram of an electric control circuit used in the autoshut-off device.

The electric control circuit 6 in FIG. 2 comprises a comparator 65 for making a comparison between the set value (pressure value) set by a setting switch 63 and an oil pressure pulse detected by the pressure sensor 5 and amplified by an amplifier 64, and counting means 66 which delivers a signal to change the communicating state of the switching valve 7 only when an oil pulse exceeds the lower limit value (set by the setting switch 63) continuously a set number of times (set by the setting switch 63).

The electric control circuit 6 shown in FIG. 3 comprises a unit 67 for retaining data whose values have been set by the setting switch 63, an A/D converter 68, and comparison operation unit 65.

The electric control circuit 6 shown in FIG. 4 includes a microcomputer 69 substituted for the comparison operation unit 65 of FIG. 3.

The operation of the autoshut-off device having the electric control circuit 6 of FIG. 2 will now be described. When the feed valve 22, the rotational control valve 23, the switching valve 7, the stopping differential pressure valve 8, and the stopping switching valve 9 are in their respective positions shown in FIG. 1, the air motor 1 is stopped, therefore, no torque is generated.

When the air feed valve 22 is switched from this state, air is fed from the air source 21 into the air motor 1 successively through the air passageway 24*a*, the air feed valve 22, the air passageway 24*b*, the rotational direction control valve 23, the air passageway 24*c*, the stopping differential pressure valve 8 and the air passageway 24*d* in the order mentioned. Further, the air leaving the air motor 1 is discharged successively through the air passageway 24*e*, the rotational direction control valve 23, the air passageways 24*f*, and the muffler 25 in the order mentioned. In such operating state, the air motor 1 is rotated, for example, forward, with its rotational output being intermittently transmitted to the main shaft 4 by the pulse generating mechanism 3. Oil pulses generated in the high pressure chamber of the pulse generating mechanism 3 depress the piston 33 in the oil pressure pulse transmitting chamber 33. Since this results in the piston 35 being depressed by the transmitting rod 36, the then—prevailing pressure in the hydraulic cylinder 34, i.e., said oil pressure pulses are read by the pressure sensor and the output signal from the latter is fed into the electric control circuit 6.

In the electric control circuit 6, the lower and upper limits of the set value and the set value for the number of times have been set.

Therefore, in the comparator 65, the set value for pressure is compared with oil pressure pulses read by the pressure sensor 5. And as long as the oil pressure pulses read by the pressure sensor 5 are lower than the lower limit value, the said operating state is maintained. Further, if the oil pressure pulse value read by the pressure sensor 5 is higher than the upper limit value, the then-prevailing operation is regarded as NG, whereupon the operation is instantly stopped and this stoppage is indicated, And if the number of times when an oil pressure pulse read by the pressure sensor 5 is higher than the set number of times, then this is detected by the counting means 66 which delivers an output. And the solenoid 71 is energized to switch the switching valve 7, whereby the stopping switching valve 9 is switched, resulting in one end of the stopping differential pressure valve 8 being communicatively connected to a discharge port 82. As a result, the stopping differential pressure valve 8 is switched to stop the feeding of air to the air motor 1 (autoshut-off function), and concurrently therewith, the pressure in the air passageway **24*d* is decreased to turn off the pressure switch 62, thereby shutting off passage of electric current to the the electric control circuit 6**.

According to such autoshut-off function, even after the oil pressure pulses reach the lower limit, the oil pressure pulses equal to said value are applied a predetermined number of times to the bolt or nut, so that the such bolt or nut can be tightly clamped. If an oil pressure pulse which exceeds the upper set value is generated, a decision that the accurate operation is not being performed is made, whereupon the operation is instantly stopped and this stoppage is indicated; thus, the reliability for tightening bolts or nuts is increased. Further, since the battery 61 contained in the housing 10 is used as the power source for the electric control circuit, there is no drawback, such as electric wiring interfering with the operation to degrade the operability or such wiring being broken.

In the above embodiment, as the reading means, use has been made of the pressure sensor 5 which detects oil pressure transmitted by the thrust of an oil pressure pulse; however, a load cell which produces compressive strains owing to an oil pressure transmitted by the thrust of an oil pressure pulse may be substituted for the pressure sensor 5. And a load cell is more advantageous from the standpoint of the attachment construction and handling, while the pressure sensor 5 is more advantageous from the standpoint of cost.

According to an autoshut-off device for oil pressure type pulse wrench as described in claim 1, the oil pressure at the time of generation of a pulse which forms the basis of a generated torque for the oil pressure type pulse wrench is detected and on the basis of the data thus obtained, torque control is effected; therefore, torque control with higher accuracy can be attained.

Particularly, according to an autoshut-off device for oil pressure type pulse wrench as described in claim 2, even after an oil pressure pulse has reached the predetermined pressure, oil pressure pulses higher than that value are applied to a bolt or nut several times; thus, more reliable tightening can be effected.

According to an autoshut-off device for oil pressure type pulse wrench as described in claim 3, a predetermined tightening force can be reliably transmitted to a bolt or nut while eliminating influences caused by some factors other than the tightening force being transmitted to the bolt or nut.

According to an autoshut-off device for oil pressure type pulse wrench as described in claim 4, the reading means can be inexpensively constructed, and according to an autoshut-off device for oil pressure type pulse wrench as described in claim 5, the handling of the reading means is facilitated.

According to an autoshut-off device for oil pressure type pulse wrench as described in claim 6, the advantage is that breakage of the electric wiring for feeding current to the electric control circuit can be prevented.

What is claimed is:

1. An autoshut-off device for an oil pressure type pulse wrench comprising:

a fluid pressure motor, a fluid pressure circuit for controlling the fluid pressure motor, a pulse generating mechanism including an oil pressure pulse transmitting chamber for intermittently transmitting rotational output to a main shaft by means of a generated pulse to impart torque to the main shaft, means for reading oil pressure pulses generated in the pulse generating mechanism, electric control means provided with counting means operative to establish a pulse count when comparing the oil pressure pulses read by said reading means with a set pressure and converting the result of this comparison into an electric signal to output the latter, and shut-off means for stopping fluid feed to said fluid pressure motor in response to the output from said electric control means when said pulse count indicates said oil pressure pulse exceeds the set pressure a predetermined number of times.

2. An autoshut-off device for an oil pressure type pulse wrench as set forth in claim 1, characterized in that the electric control means includes means for setting upper and lower limits of the set pressure and uses the lower limit during control by said counting means, the arrangement being such that an alternative NG signal is delivered when the oil pressure pulse exceeds the upper limit of the set pressure.

3. An autoshut-off device for an oil pressure type pulse wrench as set forth in any one of claim 1 or claim 3, characterized in that the reading means is a pressure sensor for detecting the fluid pressure transmitted by a thrust of the oil pressure pulses.

4. An autoshut-off device for an oil pressure type pulse wrench as set forth in any one of claims 1, or 3, characterized in that the reading means is a load cell adapted to produce compressive strains owing to fluid pressure transmitted by a thrust of the oil pressure pulses.

5. An autoshut-off device for an oil pressure type pulse wrench as set forth in any one of claims 1, or 3, characterized in that a battery contained in a housing is employed as a power source for the electric control means.

* * * * *